US005137429A

United States Patent [19]

Broadhurst

[11] Patent Number: 5,137,429

[45] Date of Patent: Aug. 11, 1992

[54] DIFFUSION PUMP

[75] Inventor: John H. Broadhurst, Golden Valley, Minn.

[73] Assignee: Spectrameasure Inc., Golden Valley, Minn.

[21] Appl. No.: 685,428

[22] Filed: Apr. 15, 1991

[51] Int. Cl.[5] ..... F04F 9/00

[52] U.S. Cl. ..... 417/152; 417/153; 417/154

[58] Field of Search ..... 417/152, 154, 153

[56] References Cited

U.S. PATENT DOCUMENTS

| | | | |
|---|---|---|---|
| 1,822,702 | 9/1931 | Kobel | 417/153 |
| 2,386,298 | 10/1945 | Downing et al. | 417/153 |
| 2,931,561 | 4/1960 | Hiesinger | 417/154 |
| 3,224,665 | 12/1965 | Milleron et al. | 417/153 |
| 3,391,857 | 7/1968 | Lucas et al. | 417/153 |
| 3,941,512 | 3/1976 | Albertin | 417/153 |

FOREIGN PATENT DOCUMENTS

| | | | |
|---|---|---|---|
| 0620775 | 5/1961 | Canada | 417/152 |
| 0918577 | 4/1980 | U.S.S.R. | 417/152 |
| 1513243 | 10/1987 | U.S.S.R. | 417/152 |

*Primary Examiner*—Richard A. Bertsch
*Assistant Examiner*—Michael I. Kocharov
*Attorney, Agent, or Firm*—Herman H. Bains

[57] ABSTRACT

A high vacua diffusion pump for use in a vacuum system including a chamber to be evacuated and a positive displacement pump. The diffusion pump includes a pump body structure having an open upper end and a closed lower end. A boiler and jet assembly is yieldably supported within the pump body and produces jet streams that impel the residual air molecules through the exit port. A ceramic heat break having a labyrinth passage therethrough positively separates the temperature of the condensing wall surface from the boiler temperature. A cooling system permits selective rapid cooling of the boiler and is openable to permit rapid re-heating of the boiler. In one embodiment, the pump includes a room temperature condensing surface, and in another embodiment a non-room temperature condensing surface is provided.

9 Claims, 1 Drawing Sheet

PDP
3
3

DIFFUSION PUMP

FIELD OF THE INVENTION

This invention relates to a diffusion pump used in high vacua systems.

BACKGROUND OF THE INVENTION

Diffusion pumps are standard components in high vacua systems. The working principle of diffusion pumps is the use of a directed stream of molecules to impact on randomly moving air molecules. The impact transfers momentum to the air molecules and sweeps them along with the directed stream. If a diffusion pump is placed between a chamber to be evacuated and a positive displacement vacuum pump, then the residual air molecules can be swept into the entrance of the positive displacement pump and exhausted into the atmosphere.

Provision must be made for separation of the directed molecular streams if the molecules are to be re-used. In practice, a condensible fluid (originally mercury, but now more often hydrocarbon, silicone oil or polyphenyl ether) is boiled to produce the directed stream of molecules, and then condensed back to a liquid to separate it from the outgoing air molecules. The practical implementation of this diffusion pump is to use a vertical tube as the pump body which is closed at the bottom, and provided near the lower end with a side exit conduit for connection to a positive displacement pump.

A boiler and jet assembly is positioned centrally within the pump body and produces several annular jets (directed streams) traveling towards the lower end of the pump and impinging eventually on the inner surface of the pump body. The upper portion of the pump body is cooled so that the gas streams condense and run down the inner surface of the pump body and into the boiler of the boiler and jet assembly. An external heater re-heats the condensate to boiling and introduces the resultant vapor into the jet assembly to repeat the process. If the open upper end of the pump body is attached to a vessel to be evacuated, then air molecules entering the pump body are swept downwards and into the positive displacement pump.

This prior art pump design has several disadvantages. The upper wall of the prior art diffusion pump is cooled to provide condensation while the lower wall is heated to boil the fluid. As the wall must be strong enough to resist atmospheric pressure, it is relatively thick and a considerable amount of the heat energy goes directly from the boiler into the cooling medium (water or forced air). Since the cooling medium is usually water, and since the boiler is exposed to open air, the working ranges of the fluids are limited to those materials which boil at relatively low temperatures, and which are liquid at the temperature of cooling water.

This limitation on the working range of the fluids used in these prior art diffusion pumps limits the performance of the prior art diffusion pumps. Mercury has a vapor pressure of about $1\times10E\text{-}3$ mm Hg at room temperature. Although air will be pumped from the evacuated vessel by diffusion pumps using mercury vapor, it (air) will be replaced by mercury vapor which is not further condensed on the room temperature walls of the diffusion pump. The organic working fluids referred to above have much lower vapor pressures at room temperatures but the heating and boiling process "cracks" the molecular structure and results in the occurrence of volatile light hydrocarbons in the vacuum system. Most clean vacuum systems use a second condenser (water, freon or liquid nitrogen cooled) between the entrance of the diffusion pump and the vacuum chamber. These secondary condensers are usually in the form of cooled baffles. Such cool baffles are effective, but reduce the probability of air molecules entering the top of the diffusion pump, and thus reduce pumping speed. It is generally impractical to keep the baffles cold indefinitely so that at warm-up times hydrocarbon fractions or mercury is emitted into the vacuum vessel. Some materials, such as silicone oils form "creep" films which eventually migrate to the vacuum side of these cold baffles and hence into the vacuum systems.

SUMMARY OF THE INVENTION

An object of this invention is to provide a novel diffusion pump which has improved thermal efficiency and pumping characteristics as compared to prior art diffusion pumps.

Another object of this invention is to provide a novel diffusion pump whose unique construction and operation permits a wide selection of vapor generating fluids that are not available for use with diffusion pumps of conventional design.

The present diffusion pump suspends the boiler and jet assembly inside the pump body structure, using a ceramic ring and a spring load. The boiler of the boiler and jet assembly is maintained at positive displacement pump vacuum on both inside and outside, and therefore can be made of light gage material. Although an electrical resistance heater is used to heat the boiler, the resistance heater is thermally insulated by the surrounding vacuum which permits heat energy to be efficiently used to boil the working fluid. In high temperature operations, the heater is surrounded by a reflector to reduce the radiated heat loss to the outside wall.

If a working fluid is used which is liquid at room temperature and which has an acceptable vapor pressure at room temperature, then direct condensation on the inner surface of a single pump wall is an acceptable way to return the pumping working fluid to the boiler. However, if fluids are chosen which are solid at room temperature, then a non-room temperature inner liner condensing surface is required. In all cases, the condensed fluid is returned to the boiler through a labyrinth passage in a ceramic heat break which positively separates the boiler temperature jet assembly from the return temperature condensing wall. This allows fluids with a wide range between boiling and condensation to be employed and insures that boiler vapor does not mingle with the exhausted air in the lower part of the pump. Prior art diffusion pumps allow mingling of the boiler vapors with the exhausted air.

The present diffusion pump can be operated with conventional fluids for application in which the contamination problem is unimportant, but it can also be operated with higher condensing temperature fluids, such as liquid arsenic, selenium, lead, tin, etc. These materials, being elemental, cannot be cracked (fractionated) while their vapor pressures at room temperatures are exceedingly small. Thus a room temperature secondary condensing surface will reduce the contamination to negligible proportions. Since the secondary condensing surface is maintained at room temperature, it can be maintained indefinitely.

Conventional prior art diffusion pumps have both convective loss of heat from the boiler to the surrounding air and also have conductive heat loss to the upper part of the pump body. These prior art diffusion pumps cool relatively quickly when the heat input is discontinued. If faster cooling is desired, cooling coils are typically supplied around the boiler. These cooling coils can be filled with water to provide rapid cooling. However, in practice, it is time consuming to drain and dry out the coils so that the boiler can be re-heated.

In the present invention, a flat plate of thermally conductive material is mounted on a bellows adjacent the lower wall of the boiler. The stiffness of the bellows is chosen so that even with the air pressure differential between inside and outside, the bellows do not extend enough to contact the boiler. If water at a modest pressure is allowed to fill the bellows, then further expansion causes the plate to contact the underside of the boiler transferring the boiler heat to the cooling water. Once the water is removed, the bellows contract thereby removing the plate from contact with the boiler and enabling a re-heat cycle to be started immediately.

FIGURES OF THE DRAWING

DESCRIPTION OF THE PREFERRED EMBODIMENT

Figures 1, 2, 3:
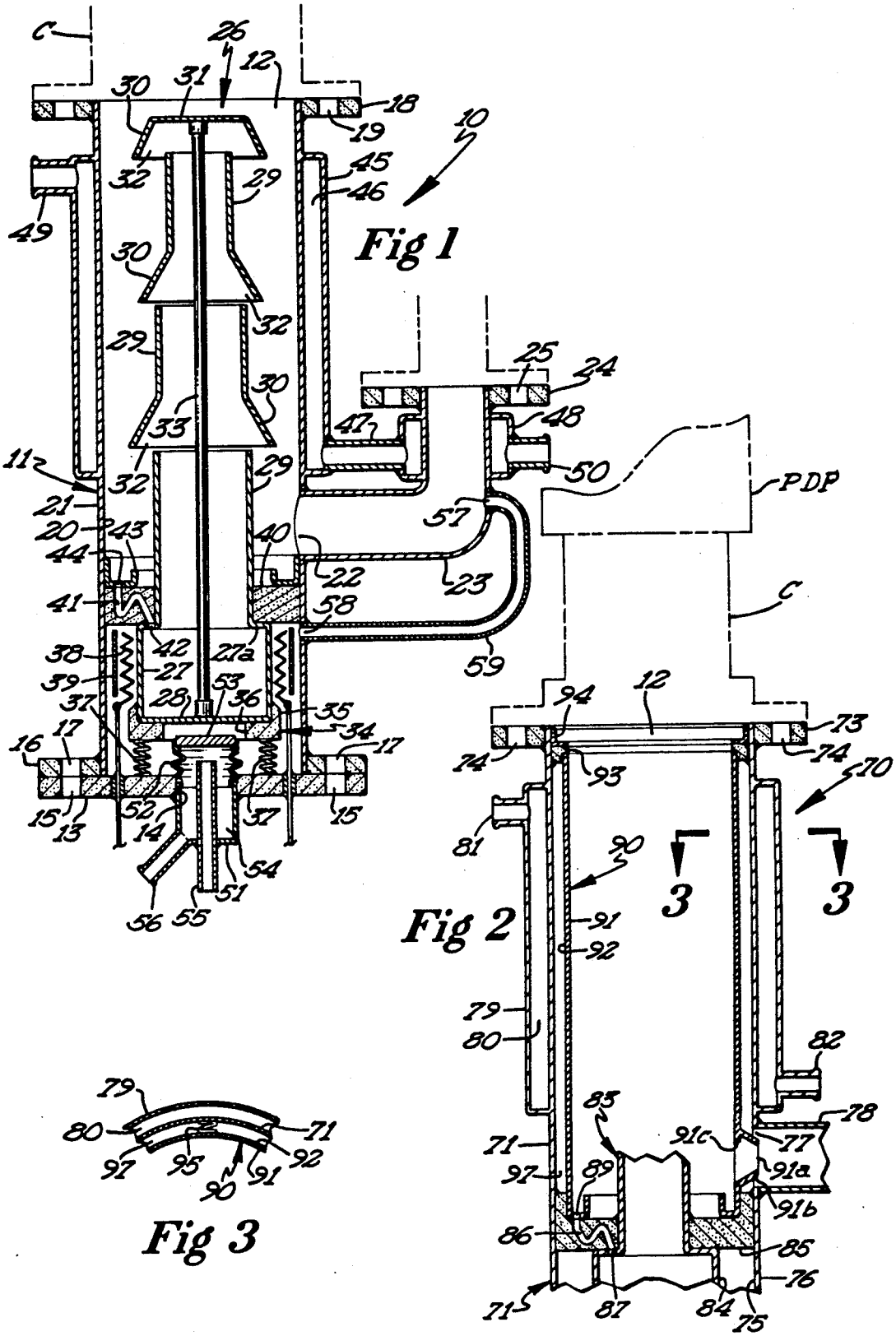
FIG. 1 is a diagrammatic cross sectional view of the novel diffusion pump.
FIG. 2 is a diagrammatic cross-sectional view of a different embodiment of the diffusion pump and, FIG. 3 is fragmentary cross-sectional view of a portion of the novel diffusion pump illustrated in FIG. 2 and illustrating one of a plurality of heat conducting elements which may be used with the diffusion pump.

Referring now to the drawings and more specifically to FIG. 1, it will be seen that one embodiment of the novel diffusion pump, designated generally by the reference numeral 10, is thereshown. The diffusion pump includes an elongate vertically disposed cylindrical pump body 11 preferably formed of stainless steel and having an open upper end 12. The lower end of the pump body 11 is closed by a support collar 13 formed of ceramic material and having a central opening 14 therein which is disposed in co-axial relation with the pump body 11. The support collar 13 also has a plurality of openings 15 therein located adjacent the periphery thereof. A lower annular ceramic member 16 is secured to the outer surface of the pump body and to the upper surface of the support collar 13. It will be noted that the ceramic member 16 also has a plurality of openings 17 therein which are disposed in registering relation with the openings 15 in the support collar 13. These openings in the ceramic members allow the pump to be mounted on a suitable support by bolts or the like.

The pump body 11 has an upper annular ceramic member 18 secured thereto at its upper end and projecting radially outwardly therefrom. The upper ceramic member 18 has a plurality of openings 19 therein which facilitate attachment of the upper end of the diffusion pump to a chamber structure C to be evacuated. The pump body 11 has a cylindrical inner surface 20, a cylindrical outer surface 21 and an exit port 22 therein adjacent the lower end thereof. An L-shaped side arm conduit 23 is connected to the pump body in registering relation with the exit port 22 and the outer end of the side arm conduit is provided with an annular ceramic member 24 which projects outwardly therefrom. The annular ceramic member 24 is provided with a plurality of openings 25 therein to facilitate connection of the side arm conduit to a positive displacement pump (PDP) typically used in vacuum systems. Air evacuated by the diffusion pump from the chamber structure C is discharged into atmosphere by the positive displacement pump.

The diffusion pump 10 also includes a jet and boiler assembly 26 which is centrally located and which is of generally conventional design and construction. The jet and boiler assembly 26 includes a cylindrically shaped boiler 27 located at the lower end of the jet and boiler assembly and which is provided with a bottom wall 28. The jet and boiler assembly 26 also includes a plurality of vertically extending cylindrical pipe sections 29 which are secured to a plurality of vertically spaced apart downwardly tapering jet elements 30. The upper most pipe section 29 is secured to a top jet cap 31 which also has a downwardly tapered jet element 30 secured thereto. The downwardly tapered jet elements cooperate with the cylindrical pipe sections to define a plurality of spaced apart jet outlets 32 through which the directed streams pass. The top jet cap 31 is secured to the upper end of an elongate mounting rod 33 which is attached to the bottom wall 28 of the boiler 27.

The jet and boiler assembly 26 must have sufficient heat conductivity so that after the heat up transient, no vapor condenses on it, or no droplets form at the jet outlets 32. Condensation of vapor and the formation of droplets interrupt the steady vapor flow from the jet outlets 32 making the pump fail intermittently and thus produce pressure surges in the vacuum system. This is particularly true of the top jet cap which receives heat only through the mounting rod 33. This rod therefore is of necessity made of a high thermal conductivity material, such as copper, clad in a passivating material such as stainless steel to avoid alloying with the working fluid.

The jet and boiler assembly 26 is actually suspended within the pump body 11 and this feature appears to be a distinct departure from prior art pumps. To this end, it will be seen that the boiler 27 engages an annular ceramic member 34 which is provided with an upturned annular lip 35. The central opening 36 of the annular ceramic member 34 is of a size to expose a major surface area portion of the bottom wall 38. A plurality of preloaded springs 37 extend between and engage the support collar and annular ceramic member 34 for yieldably supporting the jet boiler assembly. The springs 37 permit thermal expansion and contraction of the boiler and jet assembly while precluding cracking or failure of the annular ceramic member 34.

Means are provided for heating the boiler 27 and this means includes an electrical resistance heater 38 which is positioned exteriorly around the boiler 27. It is pointed out that the volumetric space located interiorly of the pump body 11 and exteriorly of the boiler 27 is at positive displacement pump vacuum and the resistance heater 38 is therefore thermally insulated with respect to convection heat loss. In this regard, the boiler 27 is at positive displacement pump vacuum at both inside and outside and can therefore be made of light gage material. A cylindrical reflector 39 is mounted exteriorly of the electrical resistance heater and serves to reduce the radiated heat loss to the pump body 11 and is highly effective in high temperature operations.

In the embodiment shown, since the diameter of the boiler 27 is slightly larger than the diameter of the adjacent cylindrical pipe section of the boiler and jet assembly, an annular shoulder 27a is defined between the boiler and the pipe section. An annular ceramic insulator 40 extends between the inner surface 20 of the pump body 11 and the exterior surface of the jet and boiler assembly 26 and engages the shoulder 27a of the boiler. The annular insulator 40 has a labyrinth passage 41 therethrough which intercommunicates the boiler and the volumetric space located between the pump body and that part of the jet and boiler assembly located above the boiler. The shoulder 27a of the boiler is provided with an opening therein which communciates with the labyrinth passage 41. A U-shaped annular trough is secured to the inner surface of the pump body and is positioned upon the annular ceramic insulator 40. The annular trough also has an opening 44 therein communicating with the labyrinth passage 41. When the vapors constituting the directed streams strike the inner surface of the pump body, the vapors will condense and will accumulate in the trough 43 and thereafter be directed through the labyrinth passage into the boiler 27 where the liquid is then re-heated.

A cylindrical shaped cooling jacket 45 is secured to and positioned around the pump body 11 and cooperates therewith to define a cooling chamber 46. The cooling chamber 46 is connected by a conduit 47 to a smaller cylindrical cooling jacket 48 which extends around the outer most portion of the L-shaped side arm conduit 23. The cooling jacket 45 is provided with an inlet 49 and the small cooling jacket 48 is provided with an outlet 50. The inlet and outlet are connected to a source of water or other coolant, and the cooling circuit includes a reservoir and suitable pump for circulating the water or coolant during operation of the diffusion pump. The coolant serves to maintain the inner surface 20 of the pump body 11 at a selected temperature during operation of the diffusion pump. For example, the inner surface of the pump body may be maintained at room temperature for working fluids that are liquid at room temperature.

Means are provided for fast boiler cooling without the attendant problems associated with rapid cooling of boilers in conventional diffusion pumps. In this regard, it will be seen that an upwardly opening cup-shaped member 51 has its upper end positioned within the central opening 14 of the support collar 13 and in engaging relation with the support collar. A bellows member 52 is secured to the support collar at its lower end and is secured at its upper end to a rigid heat exchange element 53 which is preferably formed of a high thermal conductivity material such as copper. The stiffness of the bellows 52 is chosen so that even with the air pressure differential between inside and outside, the bellows do not extend enough (in the absence of water pressure) to move the heat exchange element 53 into contact with the bottom wall 28 of the boiler 27. The interior of the cup-shaped member and bellows actually defines an expansion chamber 54.

An elongate inlet tube 55 projects through the cup-shaped member 51 and has its open upper end positioned interiorly of the bellows element 52 and above the support collar 13. An outlet tube 56 is also connected to the cup-shaped member 51. The inlet and outlet tubes are connected to a source of a coolant under pressure such as water or the like. The cooling system will include a reservoir and pump of conventional design and construction to permit water to be pumped into the expansion chamber 54 at a modest pressure which causes the bellows to expand and move the heat exchange element 53 into contact with the surface of the bottom wall 28. The circulating water or coolant permits rapid cooling of the boiler until the heat exchange element is moved out of contact with the bottom wall of the boiler by retracting the bellows element 52. This occurs when water is removed from the chamber 54 and thereby allows the heating cycle to begin again.

It will be noted that the side arm conduit 23 has a port 57 therein and that the pump body 11 has a port 58 therein located below the annular ceramic insulator 40. A conduit 59 interconnects ports 57 and 58. Ports 57 and 58 actually constitutes balancing ports and provide the means for maintaining the volumetric space between the pump body and the boiler at positive displacement pump vacuum. As pointed out above, this permits the boiler to be constructed of light gage material since it is not subjected to atmospheric pressure during operation of the diffusion pump. This vacuum level also insulates the electrical resistance heater against heat loss through convection.

During operation of the diffusion pump, a working fluid will be disposed within the boiler 27 and the resistance heater will be energized to heat the working fluid sufficiently to produce copious amounts of vapors that stream upwardly through the boiler and jet assembly to be discharged through the jet outlets 32. These directed streams of vapors collide with the residual air molecules and impel the molecules through the exit port 22 for passage into the positive displacement pump where the air is evacuated to the exterior. The directed vapor streams will eventually collide with the inner surface 20 of the pump body 11 and will condense for return to the boiler where the condensed fluids will be reheated. The latent heat of condensation will be removed by the coolant in the cooling chamber 46.

If a working fluid is used which is liquid at room temperature and which has an acceptable vapor pressure at room temperature, then the embodiment of the pump illustrated in FIG. 1 is preferred. The inner surface 20 of the pump body is preferably maintained at room temperature in this embodiment and therefore permits the use of working fluids which are liquid at room temperature pump wall.

The annular insulator 40 with its labyrinth passage functions as a ceramic heat break which positively separates the boiler temperature from the return temperature of the condensing inner surface 20. This arrangement allows fluid with a wide range between boiling and condensation to be employed and insures that boiler vapor does not mingle with exhausted air in the lower part of the pump. This type of mingling of boiler vapor with the exhausted air is permitted in conventional designs and results in a loss of pump fluid into the positive displacement pump.

Referring now to FIG. 2, it will be seen that a modified embodiment of the diffusion pump designated generally by the reference numeral 70, is thereshown. The diffusion pump 10 includes an elongate vertically disposed cylindrical pump body 71 having an open upper end and having a closed lower end (not shown) in the manner of the embodiment of FIG. 1. An upper annular ceramic member 73 is secured to the exterior surface of the pump body 71 at its upper end and projects outwardly therefrom. The annular ceramic member 73 is provided with a plurality of opening 74 therethrough to facilitate attachment of the upper end of the diffusion pump to a chamber structure C to be evacuated. The pump body 71 has a cylindrical inner surface 75 and a cylindrical outer surface 76.

The pump body 71 has an exit port 77 therein adjacent the lower end thereof and the exit port is connected to an L-shaped side arm conduit 78. A cylindrical water jacket 79 is secured to and positioned around the pump body 71 and defines a cooling chamber 80. An inlet 81 is connected in communicating relation with the cooling chamber 80 and a conduit 82 connects the cooling chamber 80 to a smaller coolant jacket positioned around the outer portion of the side arm conduit 78 in the manner of the embodiment of FIG. 1. The inlet 81 and the outlet (not shown) for the cooling system are connected to a source of a coolant under pressure and the cooling system includes a resevoir and a pump and suitable valves in the manner of the embodiment of FIG. 1. When the coolant is circulated through the cooling chamber, the pump body 71 will be cooled in the manner of the embodiment of FIG. 1.

The diffusion pump 70 is also provided with a jet and boiler assembly 83 which is also identical to the jet and boiler assembly of the embodiment of FIG. 1 and includes a boiler 84. The electrical resistance heater, the reflector, the water cooling system and the balancing ports are identical to the embodiment of FIG. 1. Therefore the interior and exterior of the boiler is at positive displacement pump vacuum in the manner of FIG. 1 and can be constructed of light gage material. The diffusion pump 70 is provided with an annular ceramic member 85 which engages the inner surface 75 of the pump body in the manner of the diffusion pump of FIG. 1. The annular ceramic member 85 is provided with a labyrinth passage 86, which communicates with an inlet port 47 in the boiler 84. An upwardly facing U-shaped annular trough 88 is positioned upon the annular ceramic member 85 and is provided with an aperture 89 therein which communicates with the labyrinth passage 86. It will therefore be seen that the diffusion pump 70, as thus described, is identical in substantially in all respects to the embodiment of the diffusion pump of FIG. 1.

However, the diffusion pump 70 is provided with an inner cylindrical liner 90 preferably formed of stainless steel and positioned interiorly of the pump body 71 in spaced concentric relation therewith. It will be seen that the lower end of the inner liner 90 is supported on the U-shaped trough 88 and that the upper end engages an L-shaped annular ceramic insulator 93. An L-shaped annular stop 94 is secured to the inner surface 75 of the pump body and engages the annular ceramic insulator 93 and serves as a mechanical stop. It will be noted that the inner liner 90 has an exit port **91*a* therein disposed in registering relation with the exit port 77 of the pump body 71. The exit port 91*a* is defined by a conical element 91*b* that project through to exit port 77. The conical shaped outlet element 91*b* is integral with the liner 90. A small depending lip 91*c*** is also integral with the inner liner and projects downwardly therefrom.

The operation of the diffusion pump 70 is identical to the operation of the diffusion pump 10 in all respects. However, the diffusion pump 70 is adapted to use working fluids which are solid at room temperature and therefore require a non-room temperature condensing surface. The primary condensing surface for the diffusion pump 70 is the inner surface 91 of the inner liner 90. Therefore this condensing surface may be maintained at a higher condensing temperature to permit the use of higher temperature condensing fluids such as liquid arsenic, selenium, lead, tin, etc. As pointed out above, these materials being elemental, cannot be cracked (fractionated) while their vapor pressures at room temperature are exceedingly small. As the condensed fluid flows down the inner liner, none will be lost through the conically shaped outlet. Any liquid dripping from the lip **91*c* will fall into the trough 88**, or will flow into the trough from the conically shaped outlet element.

In some instances, it will be necessary to maintain the condensing surface 91 of the diffusion pump 70 within relatively narrow temperature ranges dependent upon the particular working fluid selected. In this respect, a plurality of Z-shaped bridging strips 37 are disposed between the exterior surface of the inner liner 90 and the interior surface of the pump body 71. The Z-shaped bridging strips are made of a suitable metal and conduct heat from the inner liner to the outer liner where the heat of condensation, which in equalibrium must be equal to the heat provided by the boiler, is removed. The number, thickness and position of these Z-shaped bridging strips will be adjusted to maintain the desired inner liner temperature. The final disposal of the rejected heat takes place by the coolant in the cooling chamber 80.

From the forgoing, it will be seen that an improved and novel diffusion pump has been provided which functions in a more effective manner than prior art pumps.

What is claimed is that:

1. A high vacuum diffusion pump for use in a vacuum system including a positive displacement pump, comprising, a vertically disposed elongate cylindrical pump body structure having an open upper end and having an inner condensing surface, means at the lower end portion of the body structure defining a lower wall, means at the upper end of the body structure for connection to a chamber structure to be evacuated, said body structure having an exit port therein adjacent the lower end portion thereof, an elongate side arm conduit having one end thereof connected to said body structure in communicating relation with the exit port, means at the other end of the conduit for connection with a positive displacement pump, an elongate vertically disposed boiler and jet assembly positioned centrally within said body structure and including a boiler for containing a working fluid and including a plurality of vertically spaced apart jet outlets located above said boiler, electric resistance heater means positioned interiorly of said body structure and exteriorly of the boiler closely adjacent the latter for heating and boiling the working fluid within the boiler to produce copious amounts of vapors which will be directed downwardly and outwardly through the jet outlets, an annular member formed of a thermal insulating material extending between and engaging the body structure and said boiler and jet assembly adjacent said boiler, and a thermal insulating chamber, formed below said annular member, exteriorly of the boiler and interiorly of said pump body structure, means connecting said insulating chamber in communicating relation with said positive displacement pump for maintaining said insulating chamber at a vacuum level of the positive displacement pump to thereby minimize convection heat loss to the pump body structure.

2. The diffusion pump as defined in claim 1 wherein said pump body structure comprises a single cylindrical member having an inner condensing surface.

3. The diffusion pump as defined as claim 1 wherein said pump body structure comprises an elongate cylindrical member, an inner cylindrical liner positioned concentrically within and secured to said cylindrical member in spaced relation thereto, said inner liner having an inner surface defining said condensing surface.

4. The diffusion pump as defined in claim 3 and a plurality of heat conducting bridging elements extending between and engaging said cylindrical liner of said cylindrical member for conducting heat away from said inner liner.

5. The diffusion pump as defined in claim 1 wherein said boiler has a bottom wall, means extending between and engaging the bottom wall of the boiler and said bottom wall means of said pump body structure for yieldably supporting the boiler and jet assembly within said pump body means.

6. The diffusion pump as defined in claim 1 and a cooling device secured to said lower wall means of said pump body structure, said cooling device comprising a cooling expansion chamber including a normally retracted, extensible and retractable member, a thermally conductive heat transfer element secured to said extensible and retractable member, means connecting said expansion chamber in communicating relation to a source of liquid coolant under pressure whereby when liquid coolant under pressure is supplied to said expansion chamber, said extensible and retractable member will extend to move the heat transfer element into contact with the boiler to cool the same, and when the liquid coolant is removed from said expansion chamber, the extensible and retractable member will retract and move the heat transfer element out of contact with the boiler.

7. The diffusion pump as defined in claim 1 and a heat reflector member positioned around the electric resistance heater for reflecting heat radiated by the resistance heater towards said boiler.

8. The diffusion pump as defined in claim 1 and a labyrinth passage in said annular member through which the liquid working fluid passes after condensation on the inner condensing surface of the body structure, said annular member defining a heat break positively separating the boiler temperature from the return temperature of the inner condensing surface to thereby permit the use of working fluids having a wide range of temperature between boiling and condensation.

9. The diffusion pump as defined in claim 1 and a coolant jacket secured to and surrounding at least a portion of the pump body structure and cooperating therewith to define a cooling chamber, means connecting the cooling chamber to a source of liquid coolant for cooling the pump body structure.

* * * * *